US009825357B2

(12) United States Patent
Parsche

(10) Patent No.: US 9,825,357 B2
(45) Date of Patent: Nov. 21, 2017

(54) ELECTRONIC DEVICE INCLUDING PATCH ANTENNA ASSEMBLY HAVING CAPACITIVE FEED POINTS AND SPACED APART CONDUCTIVE SHIELDING VIAS AND RELATED METHODS

(71) Applicant: HARRIS CORPORATION, Melbourne, FL (US)

(72) Inventor: Francis E. Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 354 days.

(21) Appl. No.: 14/640,736

(22) Filed: Mar. 6, 2015

(65) Prior Publication Data

US 2016/0261039 A1 Sep. 8, 2016

(51) Int. Cl.
*H01Q 9/04* (2006.01)
*H01Q 1/52* (2006.01)

(52) U.S. Cl.
CPC ..... *H01Q 1/526* (2013.01); *H01Q 9/045* (2013.01); *H01Q 9/0407* (2013.01); *H01Q 9/0442* (2013.01); *H01Q 9/0457* (2013.01); *H01Q 9/0478* (2013.01)

(58) Field of Classification Search
CPC ..... H01Q 9/0407; H01Q 1/526; H01Q 9/045; H01Q 9/0457
USPC ..... 343/700 MS, 846, 841
See application file for complete search history.

(56) References Cited

U.S. PATENT DOCUMENTS

| | | | | |
|---|---|---|---|---|
| 3,921,177 | A | 11/1975 | Munson | |
| 5,515,057 | A | 5/1996 | Lennen et al. | |
| 6,181,279 | B1 | 1/2001 | Van Hoozen | |
| 6,239,750 | B1 * | 5/2001 | Snygg | H01Q 1/246 343/700 MS |
| 6,882,316 | B2 | 4/2005 | McKinzie, III et al. | |
| 7,084,815 | B2 | 8/2006 | Phillips et al. | |
| 7,202,818 | B2 | 4/2007 | Anguera Pros et al. | |
| 7,209,080 | B2 | 4/2007 | Crouch et al. | |

(Continued)

FOREIGN PATENT DOCUMENTS

WO 2013149347 10/2013

*Primary Examiner* — Dameon E Levi
*Assistant Examiner* — Hasan Islam
(74) *Attorney, Agent, or Firm* — Allen, Dyer, Doppelt, + Gilchrist, P.A.

(57) ABSTRACT

An electronic device may include wireless communications circuitry and an antenna assembly coupled thereto. The antenna assembly may include a substrate, an electrically conductive layer defining a ground plane carried by the substrate, and an electrically conductive patch antenna element carried by the substrate and spaced from the ground plane. The patch antenna element may have a symmetric axis dividing the patch antenna element into first and second symmetric areas, and first and second feed openings in the first and second symmetric areas, respectively. The antenna assembly may also include first and second feed pads in the first and second feed openings, respectively, and first and second feed lines extending through the substrate and respectively coupling the feed pads to the wireless communications circuitry. Spaced apart conductive shielding vias may be coupled to the ground plane and may extend through the substrate surrounding the patch antenna element.

42 Claims, 13 Drawing Sheets

(56) References Cited

U.S. PATENT DOCUMENTS

| | | | | |
|---|---|---|---|---|
| 7,623,073 | B2 * | 11/2009 | Teshirogi | H01Q 1/38 343/700 MS |
| 2012/0242547 | A1 * | 9/2012 | Fujii | H01Q 1/38 343/700 MS |
| 2012/0287019 | A1 * | 11/2012 | Sudo | H01Q 9/0414 343/904 |
| 2014/0225795 | A1 | 8/2014 | Yu | |

* cited by examiner

| NAME | FREQ | ANG | MAG | RX |
|---|---|---|---|---|
| m1 | 0.5500 | 90.9721 | 0.5273 | 0.5571 + 0.8136i |
| m2 | 0.4950 | 171.9990 | 0.3761 | 0.4551 + 0.0555i |
| m3 | 0.4150 | 5.1250 | 0.1401 | 1.3239 + 0.0338i |
| m4 | 0.3850 | -179.7319 | 0.3506 | 0.4808 - 0.0018i |
| m5 | 0.3500 | -119.0879 | 0.6854 | 0.2482 - 0.5608i |

ELECTRONIC DEVICE INCLUDING PATCH ANTENNA ASSEMBLY HAVING CAPACITIVE FEED POINTS AND SPACED APART CONDUCTIVE SHIELDING VIAS AND RELATED METHODS

FIELD OF THE INVENTION

The present invention relates to the field of electronic devices, and, more particularly, to patch antennas and related methods.

BACKGROUND

A patch antenna, for example, a microstrip patch antenna may provide a relatively a high gain for a given area using a relatively simple printed circuit construction, thus making its use widespread. One type of microstrip patch antenna has a radiation pattern that extends broadside to the patch plane. Such a microstrip antenna is commonly fed using a probe, for example, in the form of a connector pin or a circuit board via to form the probe that carries current to the patch surfaces.

However, the radiation bandwidth of a microstrip patch antenna may be limited. For example, the half power (3 dB) instantaneous gain bandwidth of microstrip patch antennas may be less than 20 percent in practice. This may be particularly disadvantageous compared to other types of antennas, such as parabolic reflector antennas, which can operate over many octaves of bandwidth. The frequency response of a simple, square, half wave edge, linearly polarized microstrip patch antenna may be described based upon the quadratic equation ($ax^2+bx+c=0$) so there may be a "single hump" gain maxima located about a first, half wave resonance.

The bandwidth of a microstrip patch antenna increases linearly based upon the thickness of the substrate on which it is carried, so doubling the substrate thickness may double the bandwidth and halving the substrate thickness may halve the bandwidth. Unfortunately however, problems may arise in a broadband application using a relatively thick substrate microstrip antenna, as the feed probe can radiate in a manner akin to a monopole antenna. Given that the radiation pattern of a feed probe is different than that of the patch itself, the combined thick substrate patch radiation produces an asymmetric pattern and reduced realized gain.

U.S. Pat. No. 6,181,279 to Van Hoozen discloses a patch antenna with an electrically small ground plate using peripheral parasitic stubs. More particularly, Van Hoozen discloses the parasitic stubs or shielding element is for segregating electromagnetic fields between the patch antenna and the ground plate.

U.S. Pat. No. 5,515,057 to Lennen et al. is directed to a GPS receiver with an n-point symmetrical feed double-frequency patch antenna. More particularly, Lennen et al. discloses n symmetrical feed points that are placed geometrically on the patch antenna to achieve circular polarization of the GPS receiver with an n-point antenna.

Further improvements to patch antennas may be desired. For example, it may be particularly desirable to increase bandwidth, gain, directivity, and radiation pattern symmetry.

SUMMARY

An electronic device may include wireless communications circuitry, and an antenna assembly coupled to the wireless communications circuitry. The antenna assembly may include a substrate, an electrically conductive layer defining a ground plane carried by the substrate, and an electrically conductive patch antenna element carried by the substrate and spaced from the ground plane. The electrically conductive patch antenna element may have a symmetric axis dividing the electrically conductive patch antenna element into first and second symmetric areas. The electrically conductive patch antenna element may have first and second feed openings in the first and second symmetric areas, respectively, and first and second feed pads in the first and second feed openings, respectively, defining first and second capacitive feed points. The antenna assembly may also include first and second feed lines extending through the substrate and respectively coupling the first and second feed pads to the wireless communications circuitry, and a plurality of spaced apart conductive shielding vias coupled to the ground plane and extending through the substrate surrounding the electrically conductive patch antenna element. Accordingly, the electronic device may provide increased efficiency, for example, by providing increased bandwidth, gain, and directivity.

The electrically conductive patch antenna element may have at least one bucking opening therein. The substrate may include at least one bucking recess aligned with the at least one bucking opening, for example. The antenna assembly may further include at least one conductive bucking via coupled to the ground plane and extending to the at least one bucking recess, for example.

The electronic device may further include phase delay circuitry carried by the substrate and coupled to at least one of the first and second feed lines. The phase delay circuitry may include at least one meander line, for example.

The antenna assembly may further include at least one resonator coupled to each of the first and second capacitive feed points. The at least one resonator may include at least one conductive X-shaped resonator, for example.

The electronic device may further include a dielectric cover layer carried by the electrically conductive patch antenna element. The dielectric cover layer may have a relative permittivity and a relative permittivity within 20% of each other. The substrate may have a relative permittivity and a relative permittivity within 20% of each other, for example.

A method aspect is directed to a method of making an antenna assembly. The method may include forming an electrically conductive patch antenna element on a substrate and spaced from an electrically conductive layer defining a ground plane. The electrically conductive patch antenna element may be formed to have a symmetric axis dividing the electrically conductive patch antenna element into first and second symmetric areas. The electrically conductive patch antenna element may be formed to have first and second feed openings in the first and second symmetric areas, respectively. The method may further include forming first and second feed pads in the first and second feed openings, respectively, defining first and second capacitive feed points. The method may also include forming first and second feed lines extending through the substrate and respectively coupling the first and second feed pads to wireless communications circuitry, and forming a plurality of spaced apart conductive shielding vias coupled to the ground plane and extending through the substrate surrounding the electrically conductive patch antenna element.

Another embodiment is directed to an electronic device that includes wireless communications circuitry and an antenna assembly coupled to the wireless communications circuitry. The antenna assembly may include a substrate, an electrically conductive layer defining a ground plane carried by the substrate, and an electrically conductive patch antenna element carried by the substrate and spaced from the ground plane. The electrically conductive patch antenna may have a symmetric axis dividing the electrically conductive patch antenna element into first and second symmetric areas. The electrically conductive patch may have first and second feed openings in the first and second symmetric areas, respectively, and first and second feed pads in the first and second feed openings, respectively, defining first and second capacitive feed points. The antenna assembly may also include first and second feed lines extending through the substrate, one of the first and second feed lines coupling a respective one of the first and second feed pads to the wireless communications circuitry and another of the first and second feed lines being electrically floating, and a plurality of spaced apart conductive shielding vias coupled to the ground plane and extending through the substrate surrounding the electrically conductive patch antenna element.

The ground plane may have at least one opening therein. The substrate may include at least one recess aligned with the at least one opening, for example. The another one of the first and second feed lines may extend to the at least one recess.

The antenna assembly may further include at least one resonator coupled to each of the first and second capacitive feed points. The at least one resonator may be an X-shaped resonator.

The electronic device may further include a dielectric cover layer carried by the electrically conductive patch antenna element. The dielectric cover layer may have a relative permittivity and a relative permittivity within 20% of each other. The substrate may have a relative permittivity and a relative permittivity within 20% of each other, for example.

A corresponding method of making an antenna assembly may include forming an electrically conductive patch antenna element on a substrate and spaced from an electrically conductive layer defining a ground plane ground plane. The electrically conductive patch antenna may be formed to have a symmetric axis dividing the electrically conductive patch antenna element into first and second symmetric areas. The electrically conductive patch antenna element may also be formed to have first and second feed openings in the first and second symmetric areas, respectively. The method may also include forming first and second feed pads in the first and second feed openings, respectively, defining first and second capacitive feed points and forming first and second feed lines extending through the substrate, one of the first and second feed lines coupling a respective one of the first and second feed pads to wireless communications circuitry and another of the first and second feed lines being electrically floating. The method may further include forming a plurality of spaced apart conductive shielding vias coupled to the ground plane and extending through the substrate surrounding the electrically conductive patch antenna element.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notations are used to indicate similar elements in alternative embodiments.

Figure 1:
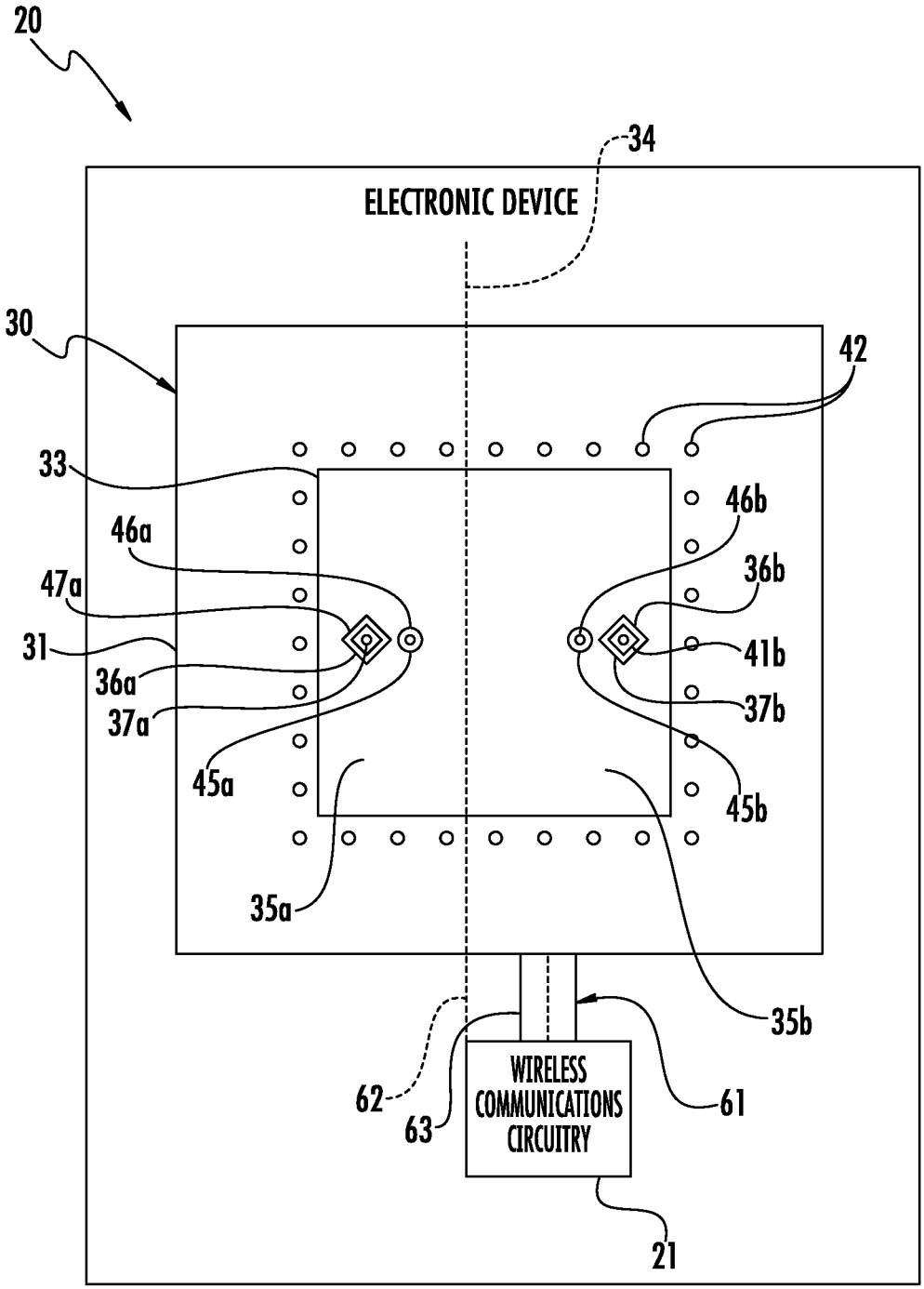
FIG. 1 is top schematic view of an electronic device according to an embodiment of the present invention.
Figure 2:
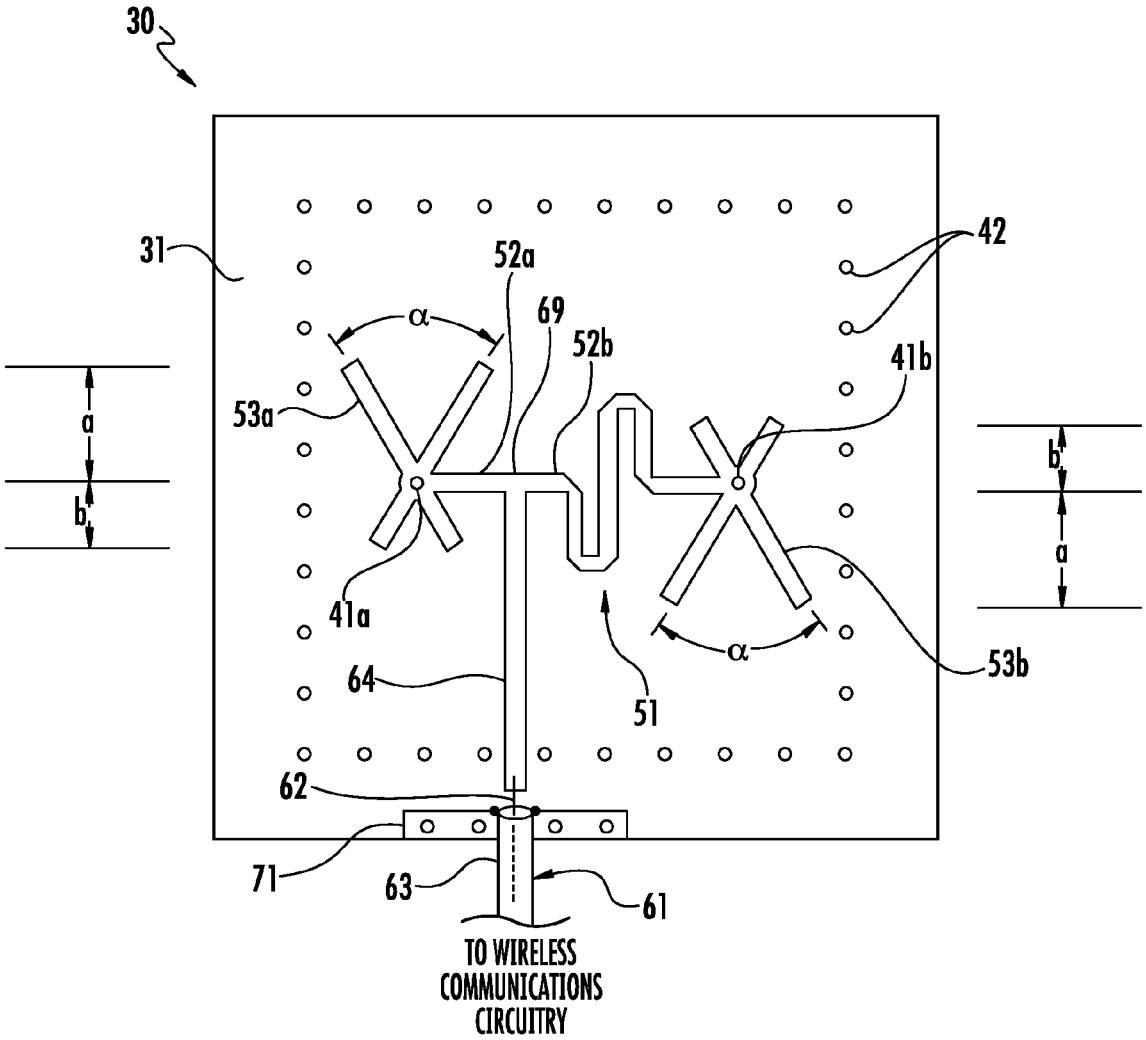
FIG. 2 is a bottom schematic view the electronic device of FIG. 1.
Figure 3:
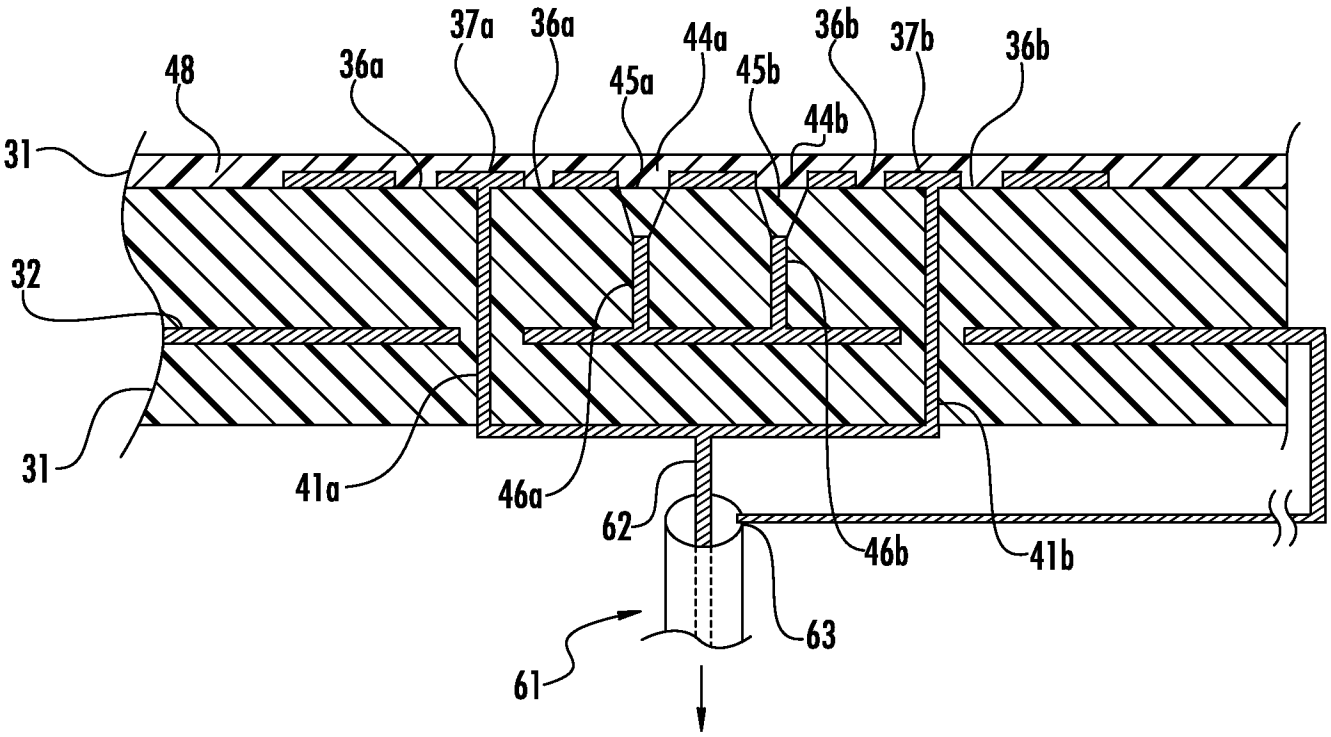
FIG. 3 is a schematic cross-sectional view of an antenna assembly in accordance with an embodiment of the present invention.

Referring initially to FIGS. 1-3, an electronic device 20 includes wireless communications circuitry 21 and an antenna assembly 30 coupled to the wireless communications circuitry. The wireless communications circuitry 21 may include a wireless transceiver, just a transmitter, just a receiver, and/or an RF power source, for example. The wireless communications circuitry 21 may include other and/or additional circuitry for wireless communication. As will be appreciated by those skilled in the art, the antenna assembly 30 may be considered a reciprocal device useful for both transmitting and receiving.

The antenna assembly 30 may be in the form of a microstrip patch antenna for linear polarization, and illustratively includes a substrate 31 and an electrically conductive layer defining a ground plane 32 carried by the substrate. The ground plane 32 is illustratively carried within the substrate 31, for example, sandwiched between two dielectric layers of the substrate. In some embodiments, the ground plane 32 may be carried by a lower surface of the substrate 31 or by another portion of the substrate. The antenna assembly 30 may be realized as a multilayer circuit board. Additional ground plane layers may be included.

The antenna assembly 30 also includes an electrically conductive patch antenna element 33 carried by an upper surface of the substrate 31. The electrically conductive patch antenna element 33 is illustratively spaced from the ground plane 32.

The electrically conductive patch antenna element 33 illustratively is in the shape of a rectangle, and more particularly, a square. Of course the electrically conductive patch antenna element 33 may have another shape, for example, a circular shape.

The electrically conductive patch antenna element 33 has a symmetric axis 34 that divides the electrically conductive patch antenna element into first and second symmetric areas 35*a*, 35*b*. The electrically conductive patch antenna element 33 has first and second feed openings 36*a*, 36*b* in the first and second symmetric areas 35*a*, 35*b*, respectively. While a particular symmetric axis 34 is illustrated, it should be understood that the symmetric axis may be aligned differently than as illustrated, for example, it may be diagonally oriented.

The electrically conductive patch antenna element 33 also includes first and second feed pads in the first and second feed openings 36*a*, 36*b*, respectively, defining first and second capacitive feed points 37*a*, 37*b*. The electrically conductive patch antenna element 33 also includes first and second feed lines 41*a*, 41*b* extending through the substrate 31 and respectively coupling the first and second feed pads or first and second capacitive feed points 37*a*, 37*b* to the wireless communications circuitry 21. The first and second feed lines 41*a*, 41*b* may be in the form of a plated through-hole via, a metal connector pin, rivet, hookup wire, or other feed structure as will be appreciated by those skilled in the art.

The first and second capacitive feed points 37*a*, 37*b* capacitively couple currents to the electrically conductive patch antenna element 33 across the air gap therebetween. The first and second capacitive feed points 37*a*, 37*b* may cancel distributed inductance of the first and second feed lines 41*a*, 41*b*.

Distributed inductance of the first and second feed lines 41*a*, 41*b* and the distributed capacitance of the first and second capacitive feed points 37*a*, 37*b* together form a series resonant circuit which may provide a double tuned antenna system for increased bandwidth. The double tuning may form a $4^{th}$ order Chebyschev response with, selected for passband ripple, a maximally flat Butterworth response, or other response shapes as will be appreciated by those skilled in the art.

The first and second capacitive feed points 37*a*, 37*b* are illustratively oriented as a diamond shape relative to the electrically conductive patch antenna element 33. This may reduce reflections to the passage of currents on the surface of the electrically conductive patch antenna element 33. Of course the first and second capacitive feed points 37*a*, 37*b* may be oriented as a square, i.e., aligned with, the electrically conductive patch antenna element 33, or have other shapes as well.

Radiation from the second feed line 41*b* is toward the opposite side of the electrically conductive patch antenna element 33 than radiation from the first feed line 41*a*. Radiation from the first and second feed lines 41*a*, 41*b* may therefore counteract each other to produce a more symmetric radiation pattern with a beam maximum more normal to the electrically conductive patch antenna element 33. It may be desirable to drive the first and second feed lines 41*a*, 41*b* at equal power and drive the second feed line at a delayed phase relative the first feed line. The delayed phase applied to the second feed line 42*b* is denoted by $\phi$ and approximately given by:

$$\phi=-(360fs)/[(c\sqrt{(\in_r\mu_r)}] \text{ degrees}$$

Where:

$\phi$=the phase delay applied to the second feed line 41*b* relative to the first feed line 41*a;*

360=a constant equal to the number of degrees in a cycle;

f=the operating frequency in Hertz;

c=the speed of light in meters/second;

s=the spacing between the vias in meters;

$\in_r$=the substrate relative permittivity (dimensionless); and $\mu_r$=the substrate relative permeability if any (dimensionless).

The minus sign occurs as a convention for adding phase shift (increased time delay). The equation derives from microstrip transmission line theory as this is the phase delay between the first and second feed lines 41*a*, 41*b* for a current traveling across the electrically conductive patch antenna element 33. In one prototype the first feed line 41*a* was at 0 degrees phase and the second feed line 41*b* was at −168 degrees phase.

Prior art circular polarized patches use multiple fed probes and quadrature phasing (superimposing cosine and sine current distributions) to cause a traveling wave current distribution on the patch. Additionally, prior art circular polarized patches implement quadrature phasing according to the Pythagorean identity:

$$\phi_n=\cos^2\theta+\sin^2(\theta+90°-90°)=\cos^2\theta+\sin^2\theta.$$

Differently, the embodiments described herein may use multiple feed lines with non-quadrature phasing (i.e., not 0, 90, 180 or 270 phase) and still render circularly polarized radiation on the patch.

Differently, the disclosed embodiments implement the feed line phasing according to:

$$\phi_n=-(360fs)/[(c\sqrt{(\in_r\mu_r)}] \text{ degrees.}$$

Spaced apart conductive shielding vias 42 are illustratively conductively connected to the ground plane 32 and extend through the substrate 31 surrounding the electrically conductive patch antenna element 33. The spaced apart conductive shielding vias 42 may provide an electrostatic shield to further attenuate unwanted radiation from the first and second feed lines 41*a*, 41*b*. The spaced apart conductive shielding vias 42 generally do not make electrical contract at their tops which may reduce capacitance between the conductive shielding vias and edges of the electrically conductive patch antenna element 33, and reduces their becoming loops or otherwise shielding radiation from the electrically conductive patch antenna element 33. The electromagnetic waves formed by the first and second feed lines 41*a*, 41*b* generally cannot pass through the comb like electrostatic shield provided by the conductive shielding vias 42. The electromagnetic wave(s) formed by edges of the electrically conductive patch antenna element 33 generally do not have to pass through the conductive shielding vias 42 so the desired radiation occurs freely.

The electrically conductive patch antenna element 33 illustratively has first and second bucking openings 44*a*, 44*b* therein. The substrate 31 has respective bucking recesses 45*a*, 45*b* aligned with the bucking openings 44*a*, 44*b*.

Respective conductive bucking vias 46*a*, 46*b* are coupled to the ground plane 32, and each extends to the level of the corresponding bucking recess 45*a*, 45*b*. The bucking vias 46*a*, 46*b* reduce undesirable radiation from the first and second feed lines 41*a*, 41*b*. Each bucking via 46*a*, 46*b* and feed line 41*a*, 41*b* carry a current flow in opposite directions to reduce via radiated fields, e.g. anti-parallel current flows. The bucking vias 46*a*, 46*b* and first and second feed lines 41*a*, 41*b* may together form an open wire transmission line, as will be appreciated by those skilled in the art.

Each bucking recess 45*a*, 45*b* may have a conical shape and may be formed by drilling downwardly from above and into the substrate 31, for example. This may advantageously reduce capacitance between each bucking via 46*a*, 46*b* and the electrically conductive patch antenna element 33. The conical point of the drill bit, for example: 1) forms a hole in the electrically conductive patch antenna element 33 and 2) reduces the height of each bucking via 46*a*, 46*b* so that the bucking via does not reach the plane of the electrically conductive patch antenna element 33.

Reduced capacitance between the bucking vias 46*a*, 46*b* and the electrically conductive patch antenna element 33 may increase bucking via current. As vias may typically be formed as plated through holes, and plating only part of the hole is difficult and undesirable, the countersink drilling may advantageously allow a via of partial height to be formed, as will be appreciated by those skilled in the art.

The electronic device 20 may further include phase delay circuitry 51 carried by the substrate 31 and coupled to the first and second feed lines 41*a*, 41*b*. The phase delay circuitry 51 illustratively includes a respective meander line 52*a*, 52*b* carried along a bottom surface of the substrate 31 for each of the first and second feed lines 41*a*, 41*b*.

The antenna assembly 30 further includes a respective resonator 53*a*, 53*b* coupled to each of the first and second feed capacitive points 37*a*, 37*b*. Each resonator 53*a*, 53*b* is conductive and illustratively an X-shape and the asymmetric X-shape as illustrated in FIG. 2. It is understood that an X-shape may include both symmetric X-shapes and assymetric X-shapes. Of course, there may be any number of resonators and arms. Additionally, each resonator 53*a*, 53*b* may have a different shape. X-shaped conductive resonators 53*a*, 53*b* may force a higher order polynomial response by increasing the number of passband ripples, as will be appreciated by those skilled in the art. The impedance response of the X-shaped conductive resonators 53*a*, 53*b*, and, in turn, the antenna frequency response, may be adjusted by the changing the overall length a+b of each the X-shaped conductive resonators and the spread angle $\alpha$ between the arms. Spread angle $\alpha$ adjusts the Q factor of the X-shaped resonators 53*a*, 53*b*. The length a+b adjusts the resonant frequency of each resonator 53*a*, 53*b*; in other words a bigger X-shaped conductive resonator has self resonance at lower frequency and a physically smaller one resonates at a higher frequency. A preferred length for a+b may be that length which results a half wave resonance from X-shaped resonator arm tip to arm tip. The ratio of a divided by b, e.g. a/b, adjusts the degree to which each asymmetric X-shaped conductive resonator electrically couples with to the antenna assembly 30. A larger ratio of a/b provides a more asymmetric X-shaped conductive resonator 53*a*, 53*b* m which may couple less into the antenna assembly 30 electrically, reducing antenna assembly 30 passband ripple. A smaller ratio of a/b means more a symmetric X-shaped conductive resonator 53*a*, 53*b* which may couple more into the antenna assembly 30 to increase bandwidth. The X-shaped resonators 53*a*, 53*b* allow a tradeoff between antenna assembly 30 passband ripple amplitude and overall bandwidth of the antenna assembly 30. Higher ripple amplitude means more bandwidth. Each resonator 53*a*, 53*b* is in effect one or more resonant circuits in parallel with the antenna. Each X-shaped conductive resonator 53*a*, 53*b* may typically carry a sinusoidal current distribution. Connecting the X-shaped conductive resonators 53*a*, 53*b* in parallel at the first and second feed lines 41*a*, 41*b* increases the antenna system 30 polynomial tuning order. A bandwidth increase of 2 to 4 fold, or even more, may be obtained when the X-shaped resonators 53*a*, 53*b* are included in the antenna assembly 30, depending on the trades of selected ripple level, spread angle $\alpha$, and X-shaped conductive resonators 53*a*, 53*b* arm length.

The first and second feed lines 41*a*, 41*b* may be fed by a coaxial antenna feed line 61 from the wireless communications circuitry 21. An outer conductor 63 of the coaxial antenna feed line 61 is coupled to the ground plane 32, for example, soldered to a via filled ground pad 71 while an inner conductor 62 of the coaxial antenna feed line is coupled to a common transmission line 64. The common transmission line 64 continues to the parallel junction 69 with the first and second feed lines 41*a*, 41*b*. RF power divides at the parallel junction 69 to feed the first and second feed lines 41*a*, 41*b*. The power division may be equal in most embodiments, but may be unequal if needed to further synthesize patterns shape, overcome transmission line losses etc. Positioning transformers the first and second feed lines 41*a*, 41*b* can adjust the branched-off impedances at the parallel junction 69 and, in turn, that power division ratio. The antenna assembly 30 may be used independently from the illustrated onboard wireless communications circuitry 21.

The antenna assembly 30 may optionally include a cover layer 48 over the upper surface of the substrate and covering the first and second feed capacitive points 37*a*, 37*b* and conductive bucking vias 46*a*, 46*b* (FIG. 3). The cover layer 48 may be a substantially nonconductive material and have a relative permittivity $\in_r$ within ±20%, and more preferably, equal to, the relative permeability $\mu_r$. In other words $\in_r \approx \mu_r$ in the cover layer 48. Advantageously, the characteristic impedance of the cover layer 48 is then nearly that of free space for all values of $\in_r \approx \mu_r$. This is because the intrinsic wave impedance in the cover layer 48 is given by $Z_{cover}=377\sqrt{(\in_r/\mu_r)}$ Ohms, and the term $\in_r/\mu_r$ generally always equals 1 whenever $\in_r$ and $\mu_r$ are the same in value so the result is or about 377 Ohms. 377 Ohms is, of course, the wave impedance of free space. The further advantage of an $\in_r \approx \mu_r$ cover layer 48 with $Z_{cover} \approx 377$ ohms is that the cover layer is then reflection-less for all values of the thicknesses of the cover layer. This is because cover layer 48 reflection coefficient is given by $\Gamma=(Z_{freespace}-Z_{cover})/(Z_{cover}+Z_{freespace})$, and since the intrinsic wave impedance of the cover layer is 377 ohms or nearly so, the numerator term of the equation is small or zero. The $\in_r \approx \mu_r$ cover layer 48 has an intrinsic wave velocity according to $v=c/\sqrt{(\in_r \mu_r)}$, so the wave may be appreciably miniaturized, and antenna size is proportional to the wavelength size, so the $\in_r \approx \mu_r$ cover layer 48 may have substantial miniaturizing effect on antenna assembly 30. A smaller antenna assembly 30 may be possible for a given frequency. In some embodiments, the substrate 31 may likewise have properties of a relative permittivity and a relative permittivity within ±20% of each other, and more particularly, $\in_r \approx \mu_r$, and which may provide a similarly miniaturized substrate with time delay, group delay, and differential phase that is more constant over frequency. Example $\in_r \approx \mu_r$ cover layer materials 48 may include light nickel zinc ferrites such as mix 68 by Fair Rite of Wallkill, N.Y., or material M5 by National Magnetics Group—TCI Ceramics of Bethlehem, Pa. Of course mixes of magnetic and dielectric powders may be used with binders to achieve a cover layer 48 with a desired value of $\in_r \approx \mu_r$.

Figure 4B:
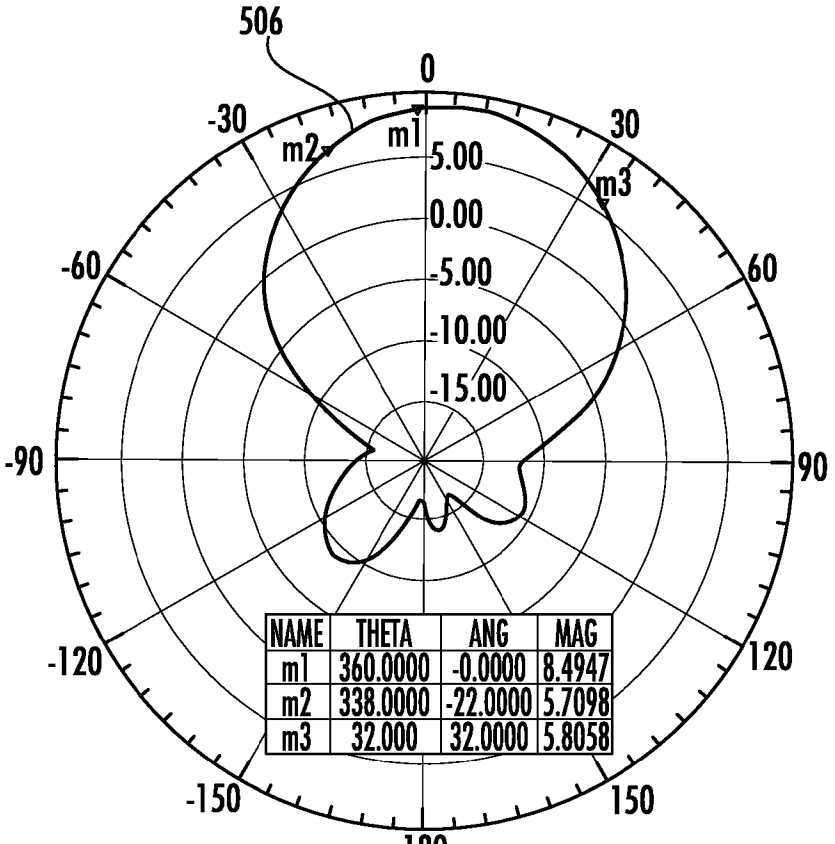
FIGS. 4A and 4B are simulated radiation pattern cuts of the antenna assembly of FIG. 1.
Figure 4A:
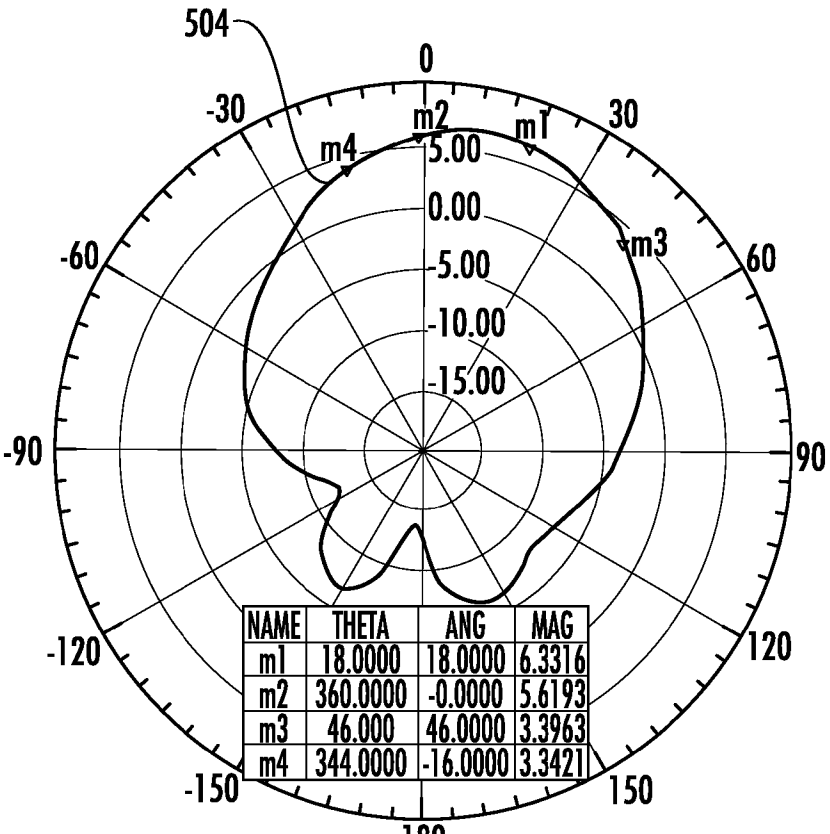

Referring to FIGS. 4A and 4B, a comparison of the radiation patterns of the antenna assembly 30 with and without one of the feed lines 41*a*, 41*b* will now be described. These radiation patterns are the E field plane cuts in polar coordinates. As background, E plane and H plane designation is a shorthand to describe the orientation of linearly polarized antennas, and for the antenna assembly 30' both the first and second feed lines 41*a*, 41*b* physically lie in that E field plane. So this is the radiation pattern cut in the plane of the probes.

Traces 504, 506 are the realized gain data in units of dBi. Realized gain includes material losses and mismatch losses. As can be seen, adding a second feed line 41*a*, 41*b* increased the radiation pattern symmetry and caused the broadside (elevation angle $\phi$=0) gain of a specific example embodiment to increase from 5.6 dBi to 8.5 dBi for a realized gain increase of 1.9 dBi. Advantageously, the radiation pattern was righted so peak pattern amplitude occurred nearly exactly at patch plane perpendicular when the additional feed line 41*a*, 41*b* was included. An additional feed line, e.g., one of the feed lines 41*a*, 41*b*, may be added to a patch antenna at little to no cost increase at the same time as the first feed line is manufactured.

A method aspect is directed to a method of making the antenna assembly 30. The method includes forming an electrically conductive patch antenna element 33 on a substrate 31 and spaced from an electrically conductive layer defining a ground plane 32. The electrically conductive patch antenna element 33 is formed to have a symmetric axis 34 dividing the electrically conductive patch antenna element into first and second symmetric areas 35*a*, 35*b*. The electrically conductive patch antenna element 33 is formed to have first and second feed openings 36*a*, 36*b* in the first and second symmetric areas 35*a*, 35*b*, respectively.

The method includes forming first and second feed pads in the first and second feed openings, respectively, defining first and second capacitive feed points 37*a*, 37*b*. The method also includes forming first and second feed lines 41*a*, 41*b* extending through the substrate 31 and respectively coupling the first and second feed pads 37*a*, 37*b* to wireless communications circuitry 21. The method also includes forming a plurality of spaced apart conductive shielding vias 42 coupled to the ground plane 32 and extending through the substrate 31 surrounding the electrically conductive patch antenna element 33.

Figure 5:
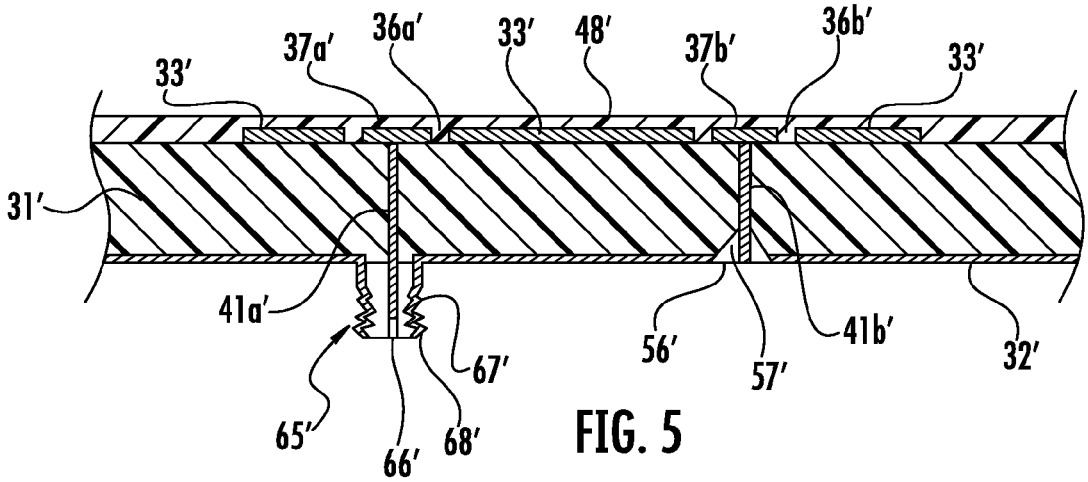
FIG. 5 is a schematic cross-sectional view of the antenna assembly of an electronic device according to another embodiment.
Figure 6:
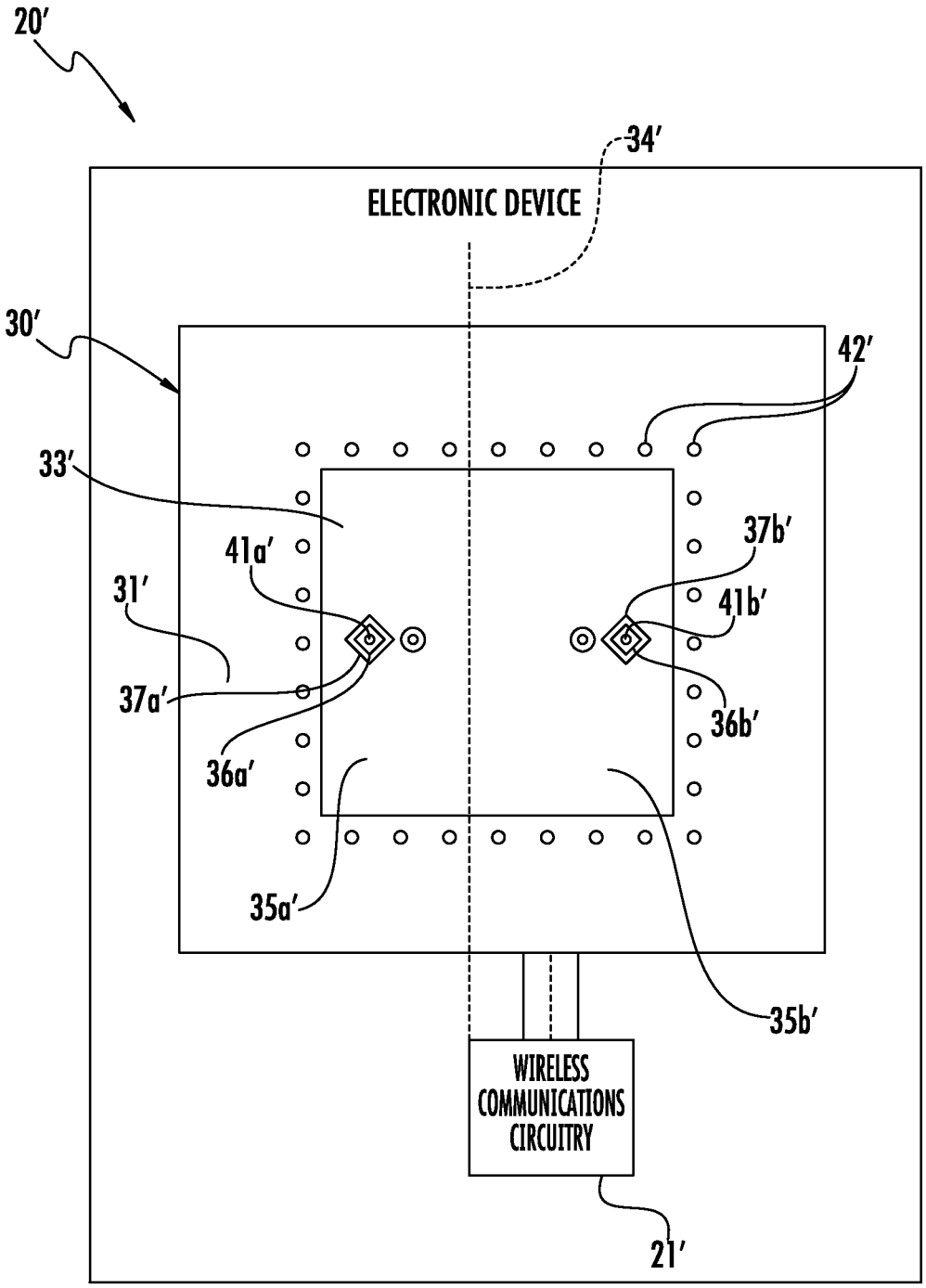
FIG. 6 is a top schematic view of the antenna assembly of FIG. 5.
Figure 7:
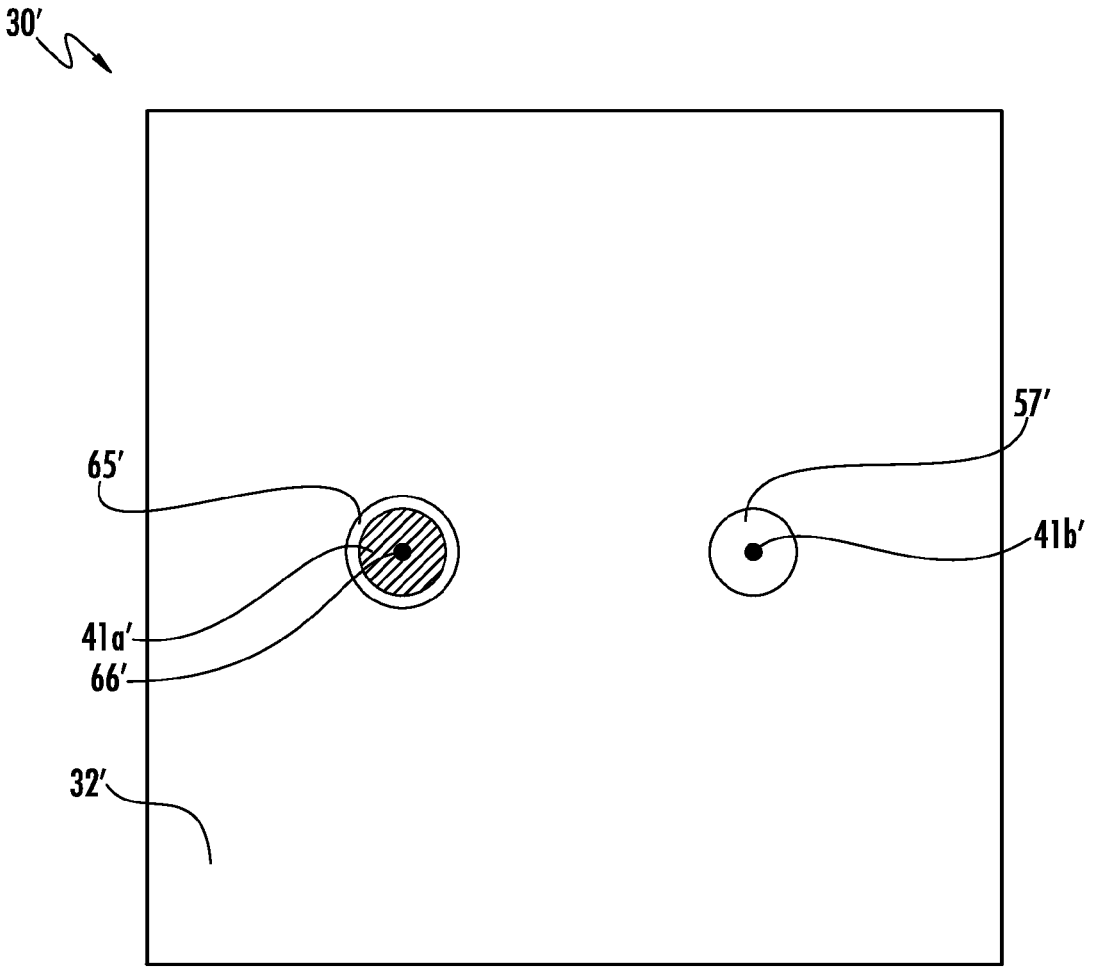
FIG. 7 is a bottom schematic view of the antenna assembly of FIG. 5.

Referring now to FIGS. 5-7, in another embodiment the antenna assembly 30' includes a substrate 31' and an electrically conductive layer defining a ground plane 32' carried by the substrate. The antenna assembly 30' also includes an electrically conductive patch antenna element 33' carried by the substrate 31' and spaced from the ground plane 32'. The antenna assembly 30' may not include a multilayer type printed circuit board, and therefore may be more economic to manufacture than the antenna assembly 30 embodiment described above.

The electrically conductive patch antenna element 33' has a symmetric axis 34' dividing the electrically conductive patch antenna element into first and second symmetric areas 35*a*', 35*b*'. The electrically conductive patch antenna element 33' has first and second feed openings 36*a*', 36*b*' in the first and second symmetric areas 35*a*', 35*b*', respectively. First and second feed pads are in the first and second feed openings, respectively, defining first and second capacitive feed points 37*a*', 37*b*'.

The antenna assembly 30' also includes first and second feed lines 41*a*', 41*b*' extending through the substrate 31'. In the illustrated embodiment, one of the first and second feed lines 41*a*' couples a respective one of the first and second feed pads 36*a*' to the wireless communications circuitry 21' (i.e., a drive feed line) and the other of the first and second feed lines 41*b*' is electrically floating.

The ground plane 32' has an opening 56' therein. The substrate 31' also has a recess 57' therein aligned with the opening 56' in the ground plane 32'. The recess 57' may be conically shaped, for example. The electrically floating feed line 41*b*' illustratively extends downwardly from the electrically conductive patch antenna element 33' to the recess 57'.

As will be appreciate by those skilled in the art, the electrically floating feed line 41*b*' may be considered a parasitic feed line and may provide useful radiation pattern symmetry without a microstrip power divider or an additional printed circuit board layer to drive it. The electrically floating feed line 41*b*' makes electrical contact with first and second capacitive feed points 37*a*', 37*b*' at an upper end thereof and makes no electrical contact with the ground plane 32' at a lower end thereof. An open circuit exists at the lower end of the electrically floating or parasitic feed line 41*b*' due to the conically shaped recess 57' and opening 56' in the ground plane 32'. The capacitive feed point 37*b*' adjacent the electrically floating feed line 41*b*' may have the same dimensions as the other capacitive feed point 37*a*'. In some embodiments, the first and second capacitive feed points 37*a*', 37*b*' may have different sizes.

The electrically floating feed line 41*b*' receives electric current from the electrically conductive patch antenna element 33'. The electric current on the electrically floating feed line 41*b*' causes monopole-like radiation, which counteracts radiation by the drive feed line 41*a*'. Radiation from the drive feed line 41*a*' squints the radiation pattern off broadside in the direction of the drive feed line, while radiation from the electrically floating feed line 41*b*' squints the radiation pattern in the direction of the electrically floating feed line. Combined radiation from the first and second feed lines 41*a*', 41*b*' (i.e., drive and electrically floating feed lines) steers the antenna radiation pattern to broadside or nearly so.

Referring to the graphs in FIGS. 7A and 7B, radiation patterns of the antenna assembly 30' with and without an electrically floating feed line 41*b*' will now be described. The patterns in FIGS. 7A and 7B are E field plane cuts. E plane and H plane is a shorthand to describe linearly polarized antenna physical orientations and for the antenna assembly 30'. Both the first and second feed lines 41*a*', 41*b*' physically lie in that E field plane. Traces 604, 606 are the simulated realized gain data in units of dBi. Realized gain includes material losses and mismatch losses. As can be seen, inclusion of the electrically floating feed line 41*b*' increased the radiation pattern symmetry and caused the broadside ($\phi$=0) gain to increase from 5.6 dBi to 8.5 dBi, a change of 1.9 dBi. The pattern peak with the electrically floating feed line 41*b*' was only 8° from patch plane broadside and only 0.3 dB lower in realized gain at patch plane normal. Advantageously, the electrically floating feed line 41*b*' pattern improvements occurred without having to configure a power divider other apparatus to drive the electrically floating feed line. Further, since at least one probe, the first feed line 41', is being implemented, adding the electrically floating feed line 41*b*' to a design can be negligible in cost. Table 1 further describes the characteristics of the example embodiment antenna assembly 30' from which the radiation patterns were obtained:

TABLE 1

| Antenna Assembly 30' Example Parameters | |
|---|---|
| Antenna type | Square microstrip patch, ½ λ edges nominal, probe driven. |

TABLE 1-continued

| Antenna Assembly 30' Example Parameters | |
|---|---|
| Special feature | Electrically floating feed line 41b', driven by patch through a capacitor pad |
| Application | Earth station antenna for AO-50 and AO-78 satellites |
| Construction method | Suspended microstrip (very thin PWB provides patch element atop a thick foam substrate) |
| Analysis method | Finite element simulation using Ansys HFSS, plus validation with a physical prototype. |
| Center frequency | 436.795 MHz (may be scaled for other frequencies) |
| Polarization | Linear |
| Electrically conductive patch antenna element 33' size | 9.345 × 9.345 inches |
| Substrate 31' Material | Styrene Foam |
| Substrate 31' thickness | 2.172 inches, $0.08\lambda_{air}$ |
| Substrate 31' relative permittivity $\epsilon_r$ | 1.045 (relative permittivity is a dimensionless number) |
| Ground plane 32' size | 28.8 × 28.8 inches |
| First and second feed lines 41a', 41b' material | #22 copper wire, passed through drilled hole and soldered to patch. |
| First feed line 41a location (driving probe location | 2.339 inches from radiating edge |
| Electrically floating feed line 41b' location | Image point, 2.339 inches from opposite radiating edge |
| X-shaped conductive resonators 53a, 53b | Not used in this example. |
| Top cover 49 | Not used in this example. |
| First and second capacitive feed points 37a', 37b' (capacitor pad size) | 0.654 × 0.654 inches |
| Matching capacitor gap, around first and second capacitive feed points 37a', 37b' | 0.050 inches |
| Matching capacitor electrical value, first and second capacitive feed points 37a', 37b' | About 3.74 picofarads. This capacitor bucks the feed probe inductance and double tunes the antenna. |
| Radiation pattern shape | Single broadside lobe, approximately $\cos^n$ fan shape |
| Realized gain, at patch plane broadside | +8.5 dBi, linear polarization |
| Realized gain, at look angle of peak radiation pattern amplitude | +8.8 dBi, at $\theta = 90°$ $\phi = 8°$ linear polarization |
| 3 dB gain beamwidth | 56° |
| 3 dB gain bandwidth | 158 MHz or 35.4% |
| Passband characteristic | Double tuned: two gain peaks with a 1 dB ripple there between. |

Figure 8A:
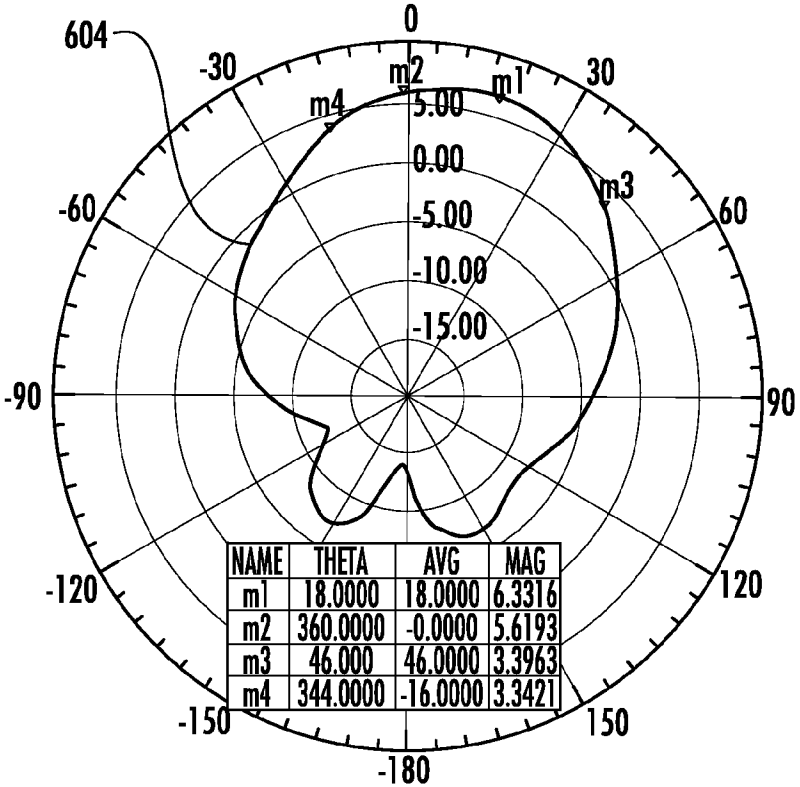
FIGS. 8A and 8B are simulated radiation pattern cuts of the antenna assembly of FIG. 5.
Figure 8B:
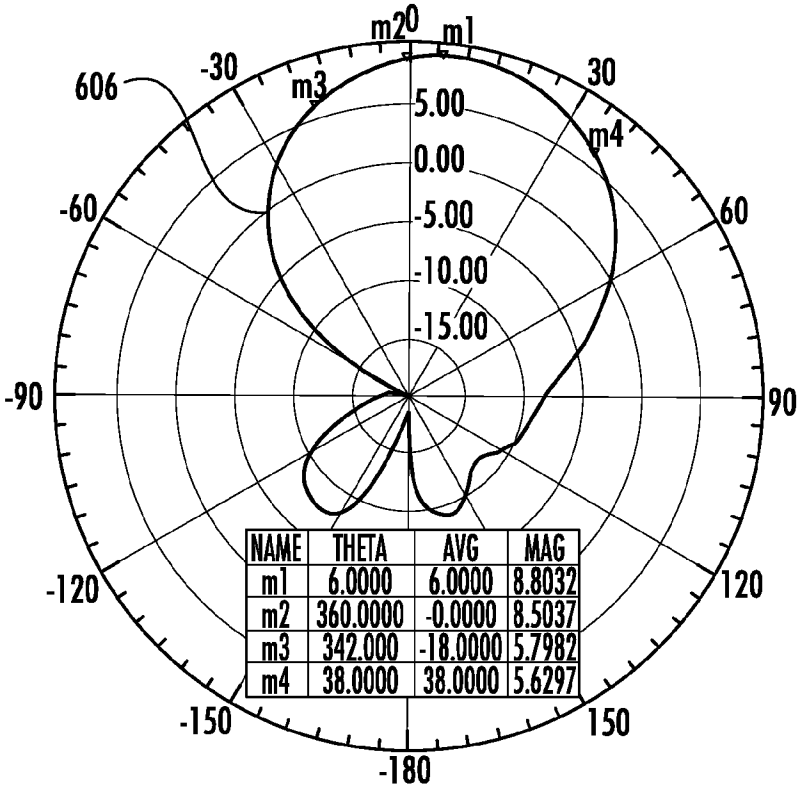

FIG. 8 is a graph of the swept gain analyzed for the Table 1 antenna assembly 30'. Trace 704 is the realized gain response over frequency. Two peaks 706, 708 can be seen as well as a dip 710. The difference between the peaks 706, 708 and the dip 701 define a response ripple that is small, less than 1 decibel.

Figure 9:
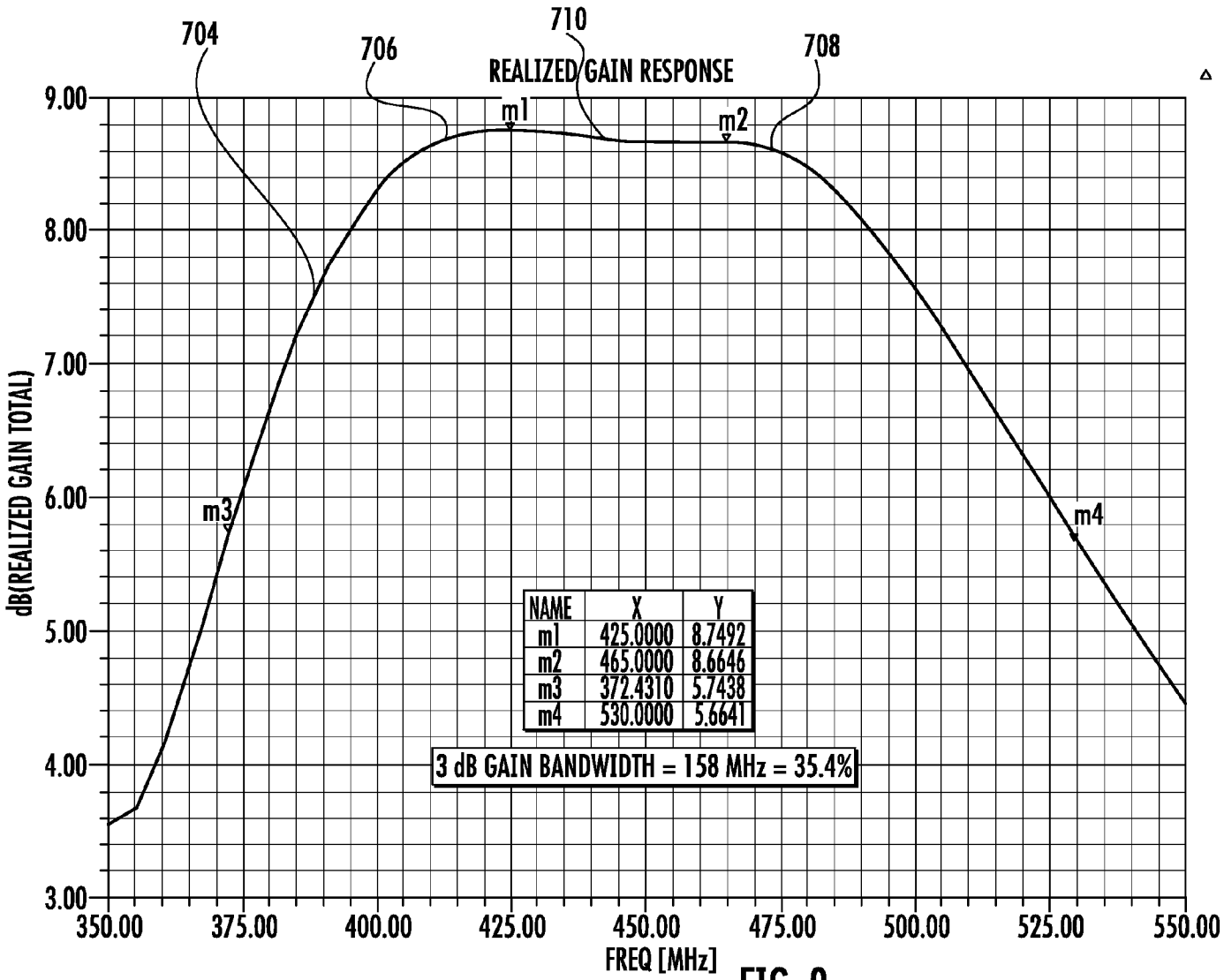
FIG. 9 is a graph of the simulated realized gain response of the antenna assembly of FIG. 5.
Figure 12:
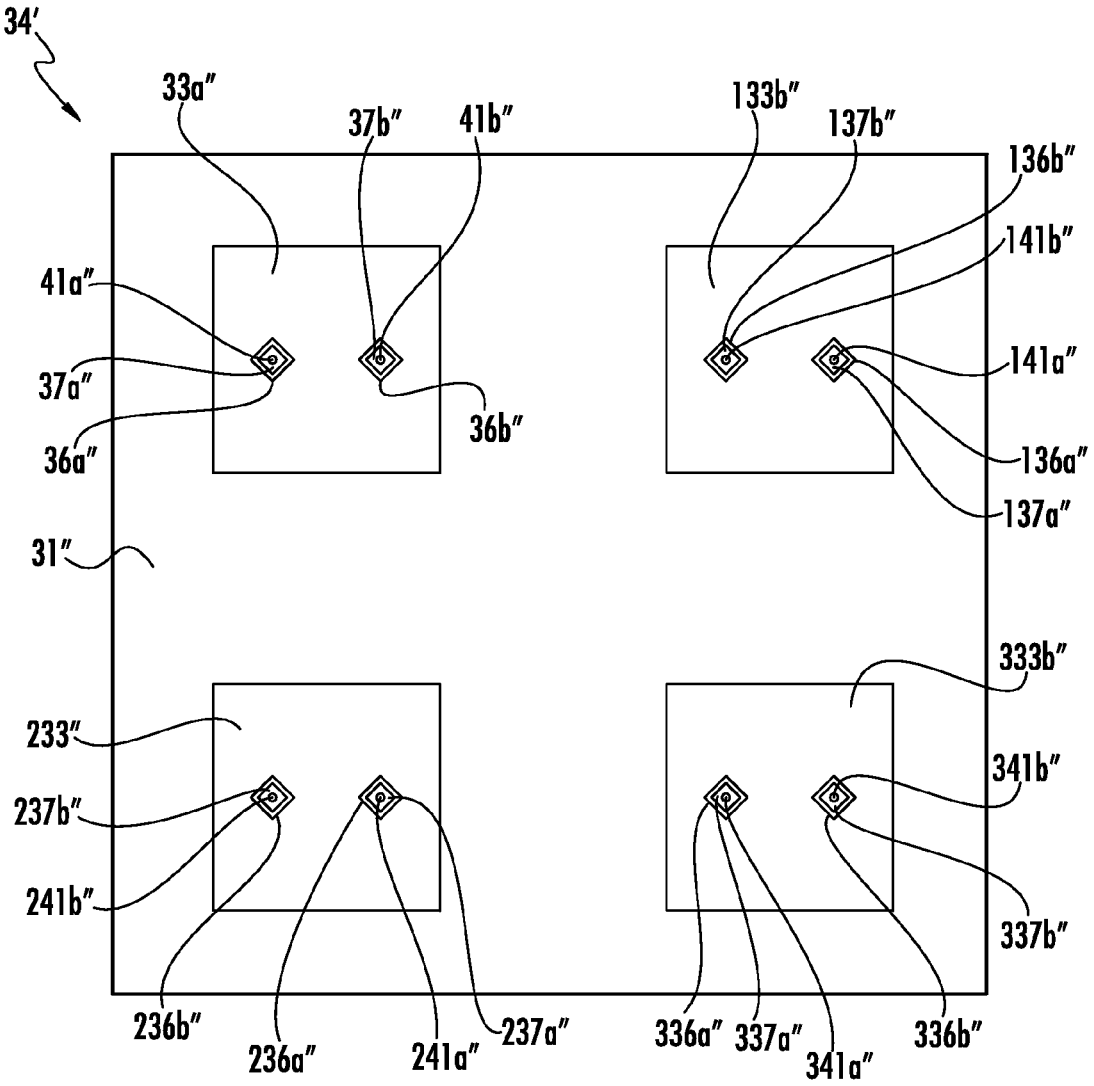
FIG. 12 is a top schematic view of an array of antenna assemblies according to another embodiment.

The Smith Chart of FIG. 9 is the driven (not floating) feed line 41*a*' impedance at the ground plane penetration. Trace 804 is a sweep of the impedance data points in frequency. The Smith Chart of FIG. 12 presents the reflection coefficient $S_{11}$. Crossover 806 represents the two gain peaks 706, 708 from the graph of FIG. 8. Moving the driven (not floating) feed line 41*a*' towards the patch edge moves the trace locus 804 to the right, and moving the driven (not floating) feed line 41*a*' towards the patch center moves the trace locus 804 to the left in the Smith Chart of FIG. 9. Marker data 808 shows the vector impedance at specific frequencies after being normalized to 50 Ohms.

Figure 10:
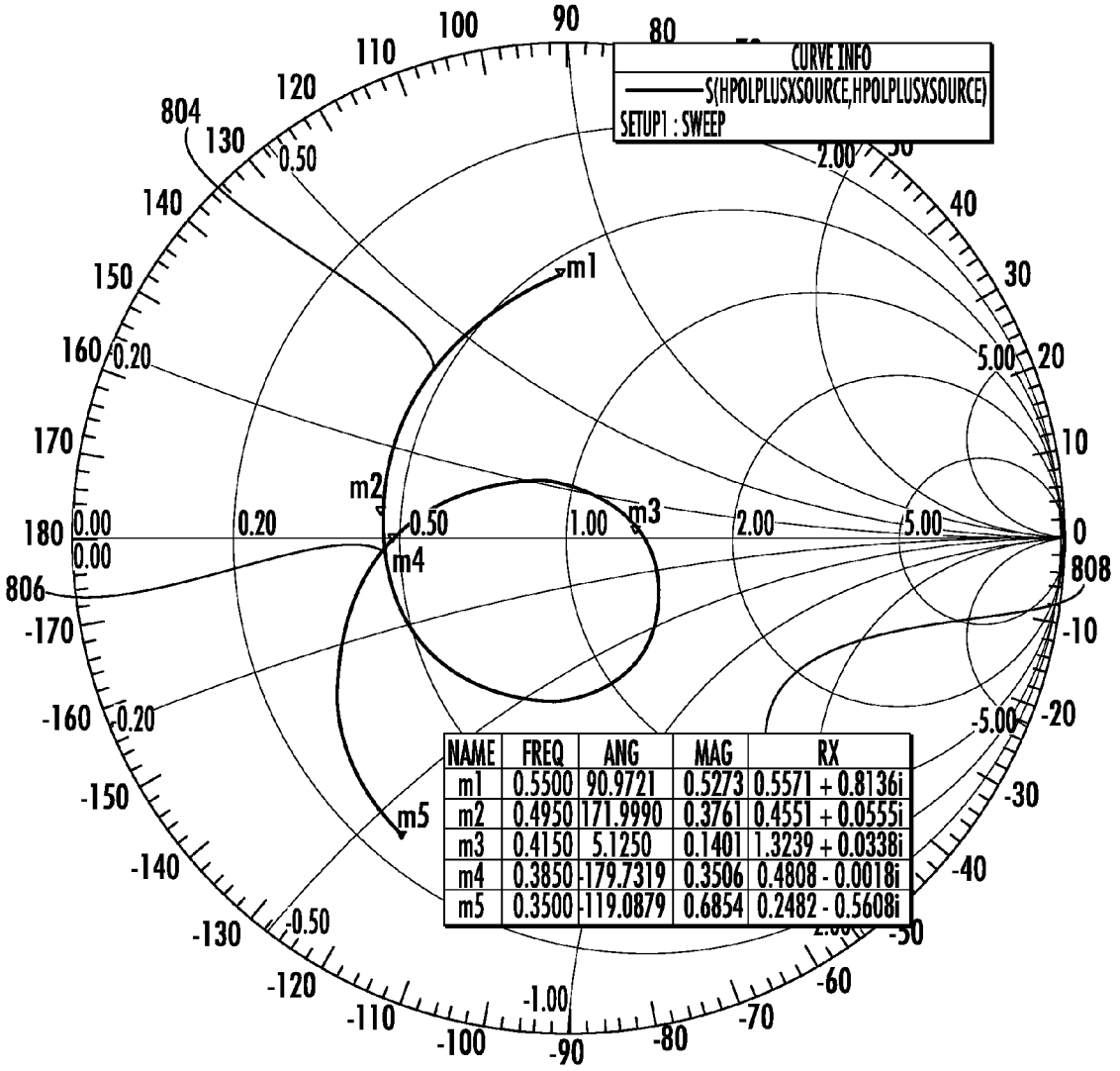
FIG. 10 is a Smith Chart of the simulated impedance of the antenna assembly of FIG. 5.
Figure 11:
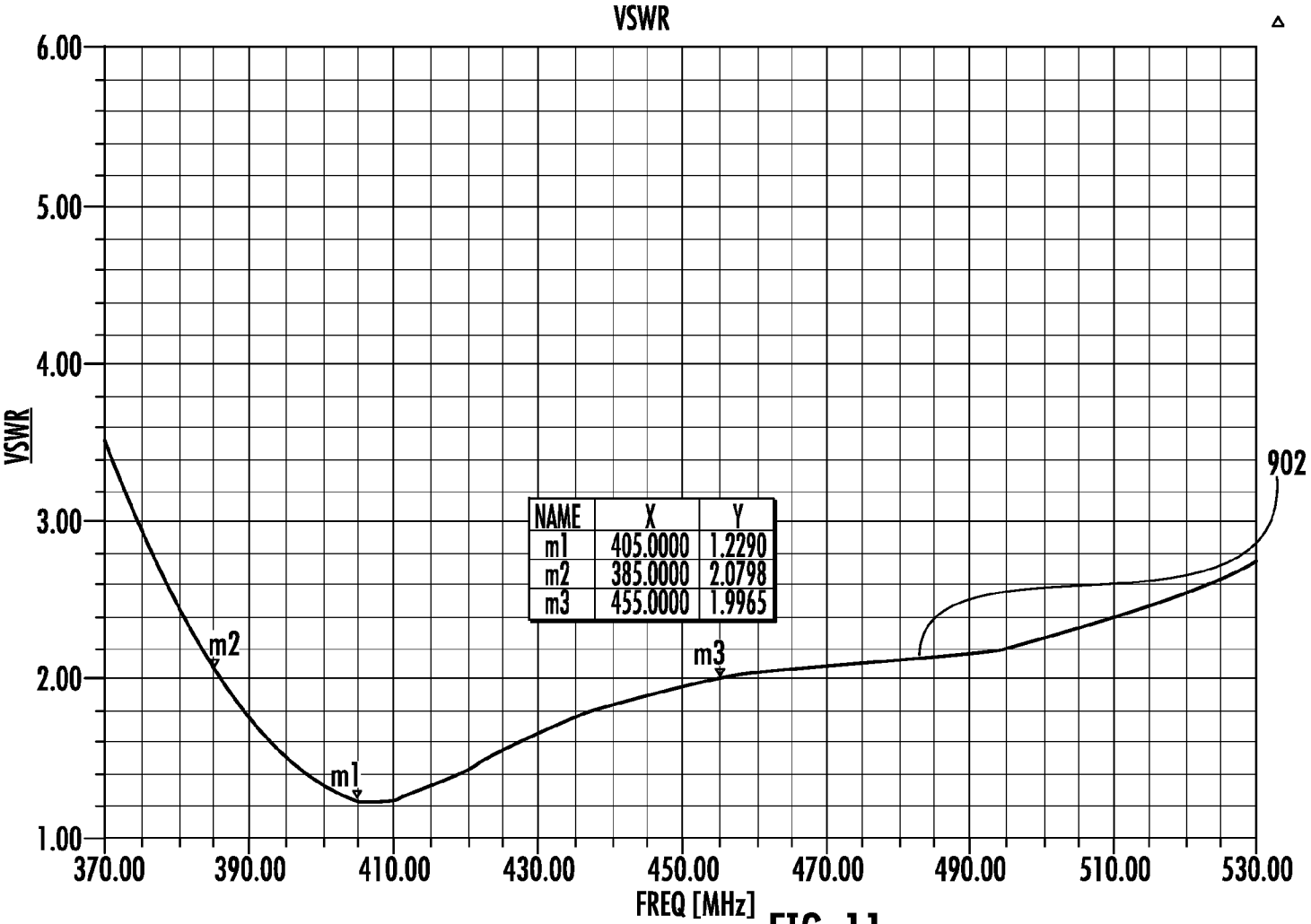
FIG. 11 is a graph of the simulated VSWR response the antenna assembly of FIG. 5.

The graph of FIG. 10 shows a simulated voltage standing wave ratio (VSWR) trace 902 as measured at the driven (not floating) feed line 41*a*' in a 50 Ohm system. The simulation was based upon a 2.17 inch thickness polystyrene foam sheet for the antenna substrate 31'. The bandwidth could be further extended with a thicker substrate material, for example. The Table 1 example and data thereof should not be construed as limiting the scope of possible antenna embodiments.

Including one or more electrically floating feed lines is beneficial for most varieties of patch antennas, including patch elements of many shapes, including circular or polygonal shapes, and for stacked patch antennas. A plurality of electrically floating feed lines can be used to improve radiation from dual polarization patch antennas, such as antennas providing simultaneous dual linear polarization and or simultaneous dual circular polarization.

Similarly to the embodiment described above with respect to FIGS. 1-3, spaced apart conductive shielding vias 42' are coupled to the ground plane 32' and extend through the substrate 31' surrounding the electrically conductive patch antenna element 33'.

A coaxial connector 65' is carried by the bottom of the substrate 31'. The ground plane 22' has an opening 66' therein to allow passage of the first feed line 41*a*', or drive feed line, to pass therethrough for coupling with an inner conductor of a coaxial cable, for example. The body 67' of the coaxial connector 65', which illustratively includes threads 68' for coupling to a mating coaxial cable connector for example, is coupled to the ground plane 32' and also couples the outer conductor of the coaxial cable to the ground plane. The antenna assembly 30 may be used independently from the illustrated onboard wireless communications circuitry 21.

A method aspect is directed to a method of making the antenna assembly 30'. The method includes forming an electrically conductive patch antenna element 33' on a substrate 31' and spaced from an electrically conductive layer defining a ground plane 32'. The electrically conductive patch antenna element 33' is formed to have a symmetric axis 34' dividing the electrically conductive patch antenna element into first and second symmetric areas 35*a*', 35*b*'. The electrically conductive patch antenna element 33' is also formed to have first and second feed openings 36*a*', 36*b*' in the first and second symmetric areas 35*a*', 35*b*', respectively.

The method includes forming first and second feed pads in the first and second feed openings 36*a*', 36*b*', respectively, defining first and second capacitive feed points 37*a*', 37*b*'. The method also includes forming first and second feed lines 41*a*', 41*b*' extending through the substrate 31'. One of the first and second feed lines 41*a*' couples a respective one of the first and second capacitive feed points 37*a*' to wireless communications circuitry 21' and another of the first and second feed lines 41*b*' is electrically floating. The method also includes forming spaced apart conductive shielding vias 42' coupled to the ground plane 32' and extending through the substrate 31' surrounding the electrically conductive patch antenna element 33'.

Figure 13:
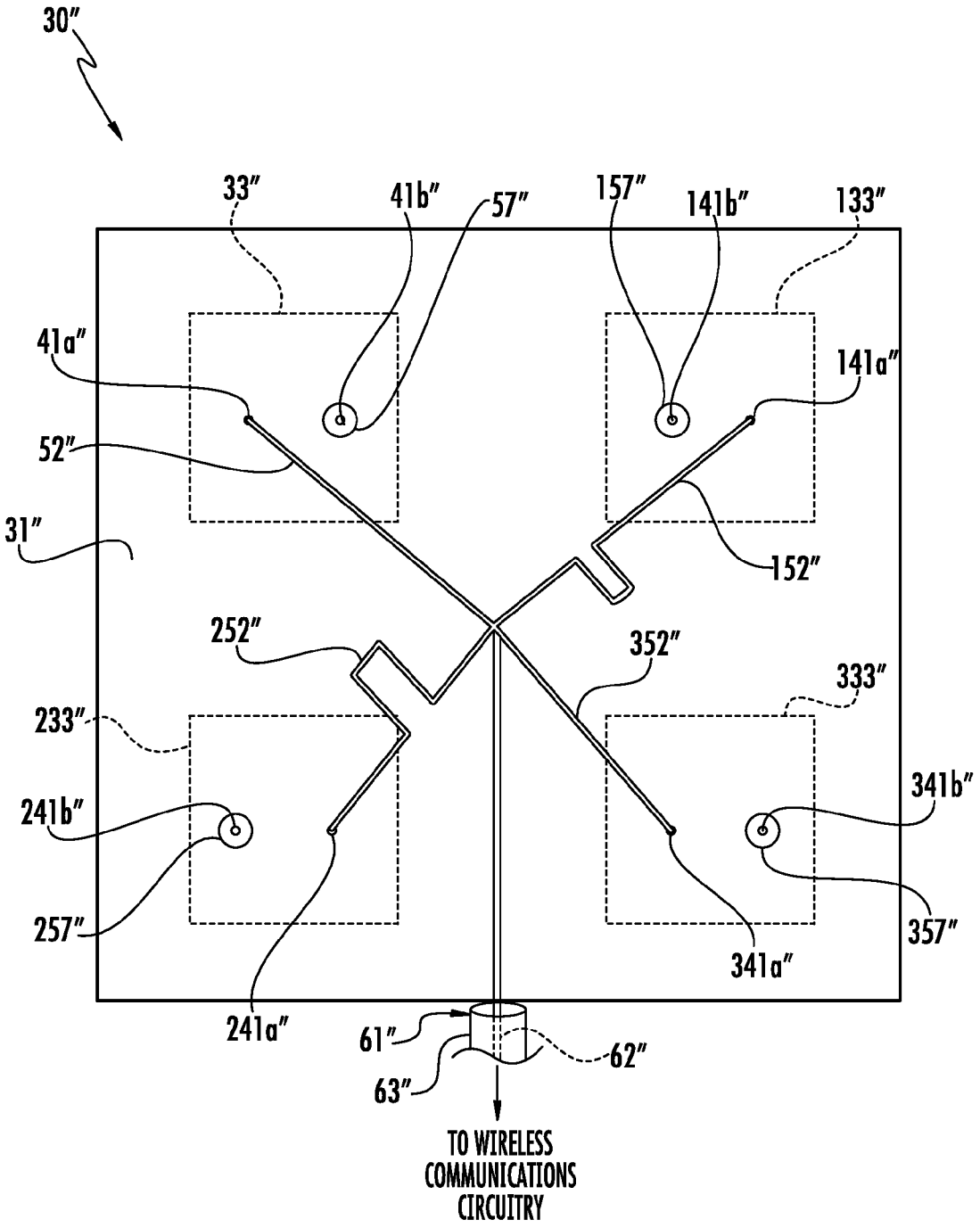
FIG. 13 is a bottom schematic view of the array of antenna assemblies of FIG. 12.

Referring now to FIGS. 12 and 13, an array 30" embodiment is now described. Illustratively, a common substrate 31" carries four electrically conductive patch antenna elements 33", 133", 233", 333", each being symmetrical and with corresponding first and second capacitive feed points and first and second feed lines as described above with respect to FIGS. 3-5 (i.e., each having a drive feed line 41*a*", 141*a*", 241*a*", 341*a*" and an electrically floating feed line 41*b*", 141*b*", 241*b*", 341*b*"). The array advantageously increases the radiation pattern symmetry by mitigating undesired feed probe radiation.

Moreover, the array 30" causes symmetric, broadside radiation. The electrically conductive patch antenna elements 33", 133", 233", 333" are alternately "clocked" so half of the electrically conductive patch antenna elements are rotated 180 degrees mechanically with respect to the others. The clocking enhances radiation pattern symmetry because if individual element radiation patterns are squinted off broadside/plane normal, the alternate clocked elements will radiate in the other direction cancelling the squint. The mechanically clocked elements are fed with an additional 180 degrees of electrical phase delay using an added length from the microstrip branch from the radial power divider, or in other words, from different length meander lines 52", 152", 252", 352".

The embodiments described herein may, for example, advantageously mitigate unwanted radiation from microstrip patch antenna feed probes, increase patch antenna radiation bandwidth, reduce patch antenna size, and improve patch antenna radiation pattern symmetry. Additionally, it should be appreciated that the antenna assembly may be a circular polarization patch antenna assembly, as well as a dual channel linear polarization antenna assembly, and a dual channel circular polarization assembly.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An electronic device comprising:

wireless communications circuitry; and an antenna assembly coupled to said wireless communications circuitry and comprising a substrate, an electrically conductive layer defining a ground plane carried by said substrate, an electrically conductive patch antenna element carried by said substrate and spaced from the ground plane, said electrically conductive patch antenna element having a symmetric axis dividing said electrically conductive patch antenna element into first and second symmetric areas, said electrically conductive patch antenna element having first and second feed openings in the first and second symmetric areas, respectively, first and second feed pads in the first and second feed openings, respectively, defining first and second capacitive feed points, first and second feed lines extending through said substrate and respectively coupling said first and second feed pads to said wireless communications circuitry, and a plurality of spaced apart conductive shielding vias coupled to said ground plane and extending through said substrate surrounding said electrically conductive patch antenna element.

2. The electronic device of claim 1, wherein said electrically conductive patch antenna element has at least one bucking opening therein.

3. The electronic device of claim 2, wherein said substrate comprises at least one bucking recess aligned with said at least one bucking opening.

4. The electronic device of claim 3, wherein said antenna assembly further comprises at least one conductive bucking via coupled to said ground plane and extending to the at least one bucking recess.

5. The electronic device of claim 1, further comprising phase delay circuitry carried by said substrate and coupled to at least one of said first and second feed lines.

6. The electronic device of claim 5, wherein said phase delay circuitry comprises at least one meander line.

7. The electronic device of claim 1, wherein said antenna assembly further comprises at least one resonator coupled to each of said first and second capacitive feed points.

8. The electronic device of claim 7, wherein said at least one resonator comprises at least one conductive X-shaped resonator.

9. The electronic device of claim 1, further comprising a dielectric cover layer carried by said electrically conductive patch antenna element.

10. The electronic device of claim 9, wherein said dielectric cover layer has a relative permittivity and a relative permittivity within ±20% of each other.

11. The electronic device of claim 1, wherein said substrate has a relative permittivity and a relative permittivity within ±20% of each other.

12. An antenna assembly comprising:

a substrate;

an electrically conductive layer defining a ground plane carried by said substrate;

an electrically conductive patch antenna element carried by said substrate and spaced from the ground plane, said electrically conductive patch antenna element having a symmetric axis dividing said electrically conductive patch antenna element into first and second symmetric areas, said electrically conductive patch antenna element having first and second feed openings in the first and second symmetric areas, respectively;

first and second feed pads in the first and second feed openings, respectively, defining first and second capacitive feed points;

first and second feed lines extending through said substrate and respectively coupling said first and second feed pads to wireless communications circuitry; and a plurality of spaced apart conductive shielding vias coupled to said ground plane and extending through said substrate surrounding said electrically conductive patch antenna element.

13. The antenna assembly of claim 12, wherein said electrically conductive patch antenna element has at least one bucking opening therein.

14. The antenna assembly of claim 13, wherein said substrate comprises at least one bucking recess aligned with said at least one bucking opening.

15. The antenna assembly of claim 14, wherein said antenna assembly further comprises at least one conductive bucking via coupled to said ground plane and extending to the at least one bucking recess.

16. The antenna assembly of claim 12, wherein said antenna assembly further comprises at least one resonator coupled to each of said first and second capacitive feed points.

17. The antenna assembly of claim 16, wherein said at least one resonator comprises at least one conductive X-shaped resonator.

18. A method of making an antenna assembly comprising:

forming an electrically conductive patch antenna element on a substrate and spaced from an electrically conductive layer defining a ground plane, the electrically conductive patch antenna element being formed to have a symmetric axis dividing the electrically conductive patch antenna element into first and second symmetric areas, the electrically conductive patch antenna element being formed to have first and second feed openings in the first and second symmetric areas, respectively;

forming first and second feed pads in the first and second feed openings, respectively, defining first and second capacitive feed points;

forming first and second feed lines extending through the substrate and respectively coupling the first and second feed pads to wireless communications circuitry; and forming a plurality of spaced apart conductive shielding vias coupled to the ground plane and extending through the substrate surrounding the electrically conductive patch antenna element.

19. The method of claim 18, wherein the electrically conductive patch antenna element is formed to have at least one bucking opening therein.

20. The method of claim 19, wherein the substrate comprises at least one bucking recess aligned with the at least one bucking opening.

21. The method of claim 20, further comprising coupling at least one conductive bucking via to the ground plane and extending to the at least one bucking recess.

22. The method of claim 18, further comprising coupling at least one resonator to each of the first and second capacitive feed points.

23. The method of claim 22, wherein the at least one resonator comprises at least one conductive X-shaped resonator.

24. An electronic device comprising:

wireless communications circuitry; and an antenna assembly coupled to said wireless communications circuitry and comprising a substrate, an electrically conductive layer defining a ground plane carried by said substrate, an electrically conductive patch antenna element carried by said substrate and spaced from the ground plane, said electrically conductive patch antenna element having a symmetric axis dividing said electrically conductive patch antenna element into first and second symmetric areas, said electrically conductive patch antenna element having first and second feed openings in the first and second symmetric areas, respectively, first and second feed pads in the first and second feed openings, respectively, defining first and second capacitive feed points, first and second feed lines extending through said substrate, one of said first and second feed lines coupling a respective one of said first and second feed pads to said wireless communications circuitry and another of said first and second feed lines being electrically floating, and a plurality of spaced apart conductive shielding vias coupled to said ground plane and extending through said substrate surrounding said electrically conductive patch antenna element.

25. The electronic device of claim 24, wherein said ground plane has at least one opening therein.

26. The electronic device of claim 25, wherein said substrate comprises at least one recess aligned with said at least one opening.

27. The electronic device of claim 26, wherein said another one of said first and second feed lines extends to the at least one recess.

28. The electronic device of claim 24, wherein said antenna assembly further comprises at least one resonator coupled to each of said first and second capacitive feed points.

29. The electronic device of claim 28, wherein said at least one resonator comprises at least one conductive X-shaped resonator.

30. The electronic device of claim 24, further comprising a dielectric cover layer carried by said electrically conductive patch antenna element.

31. The electronic device of claim 30, wherein said dielectric cover layer has a relative permittivity and a relative permittivity within ±20% of each other.

32. The electronic device of claim 24, wherein said substrate has a relative permittivity and a relative permittivity within ±20% of each other.

33. An antenna assembly comprising:

a substrate;

an electrically conductive layer defining a ground plane carried by said substrate;

an electrically conductive patch antenna element carried by said substrate and spaced from the ground plane, said electrically conductive patch antenna element having a symmetric axis dividing said electrically conductive patch antenna element into first and second symmetric areas, said electrically conductive patch antenna element having first and second feed openings in the first and second symmetric areas, respectively;

first and second feed pads in the first and second feed openings, respectively, defining first and second capacitive feed points;

first and second feed lines extending through said substrate, one of said first and second feed lines coupling a respective one of said first and second feed pads to wireless communications circuitry and another of said first and second feed lines being electrically floating; and a plurality of spaced apart conductive shielding vias coupled to said ground plane and extending through said substrate surrounding said electrically conductive patch antenna element.

34. The antenna assembly of claim 33, wherein said ground plane has at least one opening therein.

35. The antenna assembly of claim 34, wherein said substrate comprises at least one recess aligned with said at least one opening.

36. The antenna assembly of claim 35, wherein said another one of said first and second feed lines extends to the at least one recess.

37. The antenna assembly of claim 33, wherein said antenna assembly further comprises at least one resonator coupled to each of said first and second capacitive feed points.

38. The antenna assembly of claim 37, wherein said at least one resonator comprises at least one conductive X-shaped resonator.

39. A method of making an antenna assembly comprising:

forming an electrically conductive patch antenna element on a substrate and spaced from an electrically conductive layer defining a ground plane, the electrically conductive patch antenna element being formed to have a symmetric axis dividing the electrically conductive patch antenna element into first and second symmetric areas, the electrically conductive patch antenna element also being formed to have first and second feed openings in the first and second symmetric areas, respectively;

forming first and second feed pads in the first and second feed openings, respectively, defining first and second capacitive feed points;

forming first and second feed lines extending through the substrate, one of the first and second feed lines coupling a respective one of the first and second feed pads to wireless communications circuitry and another of the first and second feed lines being electrically floating; and forming a plurality of spaced apart conductive shielding vias coupled to the ground plane and extending through the substrate surrounding the electrically conductive patch antenna element.

40. The method of claim 39, wherein the ground plane has at least one opening therein; wherein the substrate comprises at least one recess aligned with the at least one opening; and wherein the another one of said first and second feed lines extends to the at least one recess.

41. The method of claim 39, further comprising coupling at least one resonator to each of the first and second capacitive feed points.

42. The method of claim 41, wherein the at least one resonator comprises at least one conductive X-shaped resonator.

* * * * *